US010049615B2

(12) United States Patent
Choe

(10) Patent No.: US 10,049,615 B2
(45) Date of Patent: Aug. 14, 2018

(54) DEGRADATION COMPENSATING DEVICE AND DISPLAY DEVICE HAVING THE SAME

(71) Applicant: SAMSUNG DISPLAY CO., LTD., Yongin-si, Gyeonggi-do (KR)

(72) Inventor: Eun-Gyeong Choe, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 178 days.

(21) Appl. No.: 15/097,153

(22) Filed: Apr. 12, 2016

(65) Prior Publication Data

US 2017/0092190 A1 Mar. 30, 2017

(30) Foreign Application Priority Data

Sep. 24, 2015 (KR) ..... 10-2015-0135601

(51) Int. Cl.
*G09G 3/20* (2006.01)
*G09G 3/3225* (2016.01)
(Continued)

(52) U.S. Cl.
CPC ..... *G09G 3/3225* (2013.01); *G09G 3/2003* (2013.01); *G09G 3/3208* (2013.01); *G09G 3/3233* (2013.01); *G09G 3/3266* (2013.01); *G09G 3/3275* (2013.01); *G09G 2300/0819* (2013.01); *G09G 2310/08* (2013.01);
(Continued)

(58) Field of Classification Search
CPC .. G09G 3/2003; G09G 3/3208; G09G 3/3225; G09G 3/3233; G09G 3/3266; G09G 3/3275; G09G 2300/0819; G09G 2310/08; G09G 2320/029; G09G 2320/04; G09G 2320/043; G09G 2320/045; G09G 2320/048; G09G 2320/0233; G09G 2320/0242; G09G 2320/0285;
(Continued)

(56) References Cited

U.S. PATENT DOCUMENTS

2004/0263538 A1* 12/2004 Ohta ..... G09G 3/2022 345/690
2005/0110420 A1* 5/2005 Arnold ..... G09G 3/3225 315/169.3
2007/0176862 A1* 8/2007 Kurt ..... G09G 3/2092 345/82
2007/0195040 A1* 8/2007 Park ..... G09G 3/3648 345/89
2007/0296668 A1* 12/2007 Kim ..... G09G 3/3611 345/89
2009/0213049 A1* 8/2009 McCreary ..... G09G 3/3233 345/80
2009/0244055 A1* 10/2009 Asano ..... G09G 3/3233 345/214
2015/0042697 A1* 2/2015 Park ..... G09G 3/2092 345/690

FOREIGN PATENT DOCUMENTS

KR 10-2008-0060890 A 7/2008

* cited by examiner

*Primary Examiner* — Michael J Eurice
(74) *Attorney, Agent, or Firm* — Lewis Roca Rothgerber Christie LLP

(57) ABSTRACT

A display device may include a display panel including a plurality of pixels and sensing lines respectively coupled to the pixels, a degradation compensator configured to detect a degradation of the pixels based on a current flowing through the pixels and to compensate a brightness and a color difference of a first region including at least one of the pixels coupled to a respective one of the sensing lines, through which the degradation is detected, based on a first sensing data of the first region and a second sensing data of a second region including pixels adjacent the pixels of the first region, a data driver configured to provide data signals to data lines, a scan driver configured to provide scan signals to the pixels, and a timing controller configured to generate control signals which control the degradation compensator, the data driver, and the scan driver.

20 Claims, 8 Drawing Sheets

(51) Int. Cl.

| | |
|---|---|
| *G09G 3/3275* | (2016.01) |
| *G09G 3/3208* | (2016.01) |
| *G09G 3/3233* | (2016.01) |
| *G09G 3/3266* | (2016.01) |

(52) U.S. Cl.
CPC ..... *G09G 2320/029* (2013.01); *G09G 2320/0233* (2013.01); *G09G 2320/0242* (2013.01); *G09G 2320/0285* (2013.01); *G09G 2320/04* (2013.01); *G09G 2320/043* (2013.01); *G09G 2320/045* (2013.01); *G09G 2320/048* (2013.01); *G09G 2320/0626* (2013.01); *G09G 2320/0693* (2013.01); *G09G 2360/16* (2013.01)

(58) Field of Classification Search
CPC ... G09G 2320/0626; G09G 2320/0693; G09G 2360/16
See application file for complete search history.

DEGRADATION COMPENSATING DEVICE AND DISPLAY DEVICE HAVING THE SAME

CROSS-REFERENCE TO RELATED APPLICATION

This application claims priority to, and the benefit of, Korean Patent Application No. 10-2015-0135601, filed on Sep. 24, 2015 in the Korean Intellectual Property Office (KIPO), the contents of which are incorporated herein in their entirety by reference.

BACKGROUND

1. Field

Example embodiments relate generally to a degradation compensating device, a display device having the same, a pixel, and a display device having the same.

2. Description of the Related Art

Flat panel display (FPD) devices are widely used as display devices of electronic devices because FPD devices are relatively lightweight and thin compared to cathode-ray tube (CRT) display devices. Examples of FPD devices are liquid crystal display (LCD) devices, field emission display (FED) devices, plasma display panel (PDP) devices, and organic light emitting diode (OLED) display devices. OLED devices have been spotlighted as next-generation display devices because OLED devices have various features, such as a wide viewing angle, rapid response speed, a thin profile, low power consumption, etc.

A pixel in an OLED device may degrade as time passes. A brightness of the pixel, which is emitted based on the data signal, may be reduced. Thus, a method for detecting a degraded pixel and for compensating the degraded pixel is studied.

SUMMARY

Some example embodiments provide a degradation compensating device capable of compensating a degradation of a pixel.

Some example embodiments provide a display device capable of compensating a degradation of a pixel.

According to an aspect of example embodiments, a degradation compensating device may include a degradation determiner coupled to sensing lines in a display panel, the degradation determiner being configured to detect current flowing through pixels respectively coupled to the sensing lines and to detect a degradation of the pixels based on the current, a sensor configured to assign a first region including at least one of the pixels which is coupled to one of the sensing lines through which the degradation is detected, to assign a second region including ones of the pixels adjacent the first region, to sense a first sensing data of the first region, and to sense a second sensing data of the second region, a degradation calculator configured to determine whether the pixels in the first region are degraded based on the first sensing data and the second sensing data and to calculate a compensating amount of the degradation of the first region, a brightness calculator configured to calculate a brightness compensating amount, for compensating the brightness of the first region, based on the compensating amount of the degradation, a color difference calculator configured to calculate a color compensating amount, for compensating the color difference of the first region, based on the compensating amount of the degradation, and an image compensator configured to compensate image data based on the brightness compensating amount and the color difference compensating amount.

In example embodiments, the degradation determiner may be further configured to detect the degradation of the pixels when the current is lower than a reference current.

In example embodiments, the first sensing data includes an amount of a first current which flows through the pixels in the first region, and wherein the sensor outputs the first sensing data based on the first current.

In example embodiments, the second sensing data includes an amount of a second current which flows through the pixels in the second region, and wherein the sensor outputs the second sensing data based on the second current.

In example embodiments, the degradation calculator may determine that the pixels in the first region are degraded when the first sensing data is lower than an average value of the second sensing data.

In example embodiments, the degradation calculator may calculate the compensating amount of the degradation using a difference between the first sensing data and the average value of the second sensing data.

In example embodiments, the brightness calculator may include a look up table (LUT) for storing the brightness compensating amount corresponding to the compensating amount of the degradation.

In example embodiments, the color difference calculator may include a look up table (LUT) for storing the color compensating amount corresponding to the compensating amount of the degradation.

In example embodiments, the image compensator may compensate a color coordinate of the image data for the first region based on the color compensating amount using a gamut mapping algorithm (GMA).

According to an aspect of example embodiments, a display device may include a display panel including a plurality of pixels and sensing lines respectively coupled to the pixels, a degradation compensator configured to detect a degradation of the pixels based on a current flowing through the pixels and to compensate a brightness and a color difference of a first region including at least one of the pixels coupled to a respective one of the sensing lines, through which the degradation is detected, based on a first sensing data of the first region and a second sensing data of a second region including pixels adjacent to the pixels of the first region, a data driver configured to provide data signals to the pixels, a scan driver configured to provide scan signals to the pixels, and a timing controller configured to generate control signals which control the degradation compensator, the data driver, and the scan driver.

In example embodiments, the degradation compensator may include a degradation determiner configured to detect the current flowing through the pixels and to detect the degradation of the pixels based on the current, a sensor configured to assign the first region and the second region and to sense the first sensing data and the second sensing data, a degradation calculator configured to determine whether the pixels in the first region are degraded based on the first sensing data and the second sensing data and to calculate a compensating amount of the degradation of the first region, a brightness calculator configured to calculate a brightness compensating amount for compensating the brightness of the first region based on the compensating amount of the degradation, a color difference calculator configured to calculate a color compensating amount for compensating the color difference of the first region based on the compensating amount of the degradation, and an image compensator configured to compensate image data based on the brightness compensating amount and the color compensating amount.

In example embodiments, the degradation determiner may detect the degradation of the pixels when the current is lower than a reference current.

In example embodiments, the sensor may sense a first current flowing through the pixels in the first region and output the first sensing data based on the first current.

In example embodiments, the sensor may sense a second current flowing through the pixels in the second region and output the second sensing data based on the second current.

In example embodiments, the degradation calculator may determine that the pixels in the first region are degraded when the first sensing data is lower than an average value of the second sensing data.

In example embodiments, the degradation calculator may calculate the compensating amount of the degradation using a difference between the first sensing data and the average value of the second sensing data.

In example embodiments, the brightness calculator may include a look up table (LUT) for storing the brightness compensating amount corresponding to the compensating amount of the degradation.

In example embodiments, the color difference calculator may include a look up table (LUT) for storing the color compensating amount corresponding to the compensating amount of the degradation.

In example embodiments, the image compensator may compensate a color coordinate of the image data for the first region based on the compensating amount of the color difference using a gamut mapping algorithm (GMA).

In example embodiments, the degradation compensator may be coupled to the timing controller or located in the timing controller.

Therefore, a degradation compensating device and a display device having the same may compensate a brightness and a color difference of image data provided to a degradation region based on an average value of sensing data detected in the degradation region and in adjacent regions to the degradation region. Therefore, the display device may display a high-quality image on the display panel.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
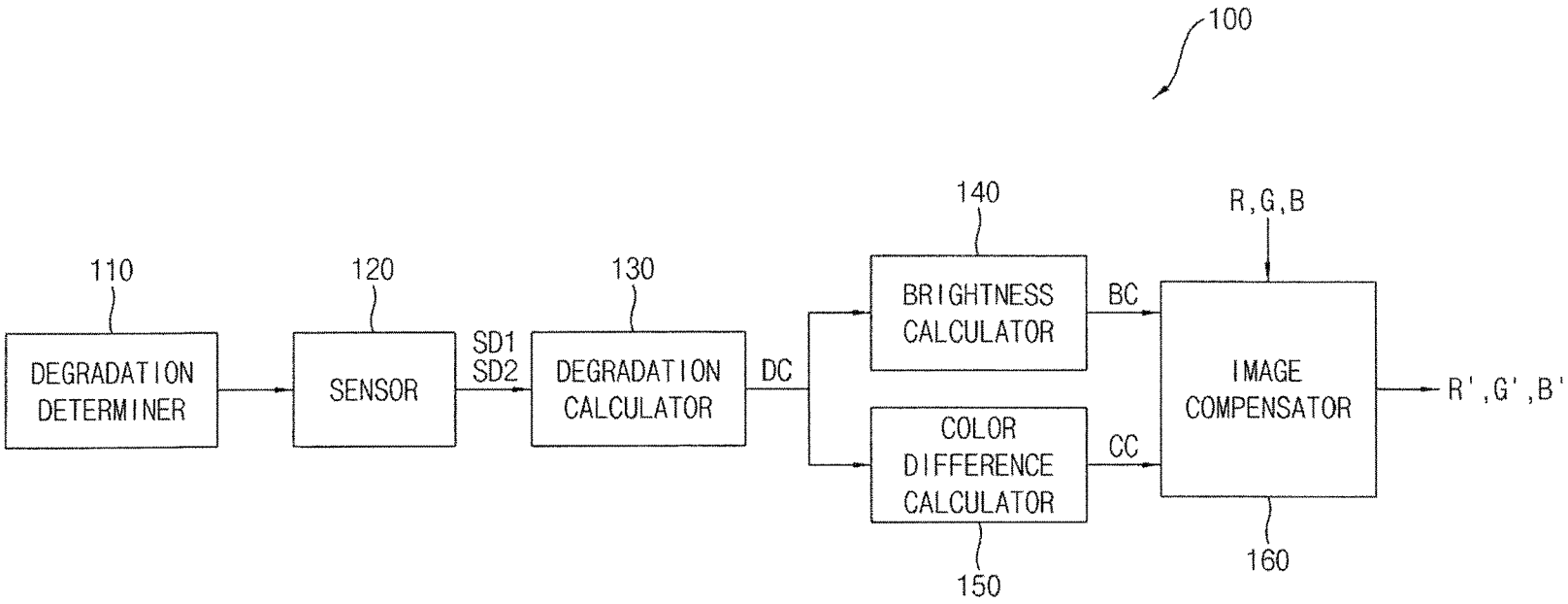
FIG. 1 is a block diagram illustrating a degradation compensating device according to example embodiments.

Hereinafter, the present inventive concept will be explained in detail with reference to the accompanying drawings.

It will be understood that, although the terms "first," "second," "third," etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section, without departing from the spirit and scope of the present invention.

Spatially relative terms, such as "beneath," "below," "lower," "under," "above," "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below," "beneath," or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent" another element or layer, it can be "directly on," "directly connected to," "directly coupled to," "directly connected with," "directly coupled with," or "directly adjacent" the other element or layer, or one or more intervening elements or layers may be present. Furthermore "connection," "connected," etc. may also refer to "electrical connection," "electrically connected," etc. depending on the context in which such terms are used as would be understood by those skilled in the art. When an element or layer is referred to as being "directly on," "directly connected to," "directly coupled to," "directly connected with," "directly coupled with," or "immediately adjacent" another element or layer, there are no intervening elements or layers present.

As used herein, "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

FIG. 1 is a block diagram illustrating a degradation compensating device according to example embodiments.

Referring to FIG. 1, a degradation compensating device 100 may include a degradation determiner 110, a sensor 120, a degradation calculator 130, a brightness calculator 140, a color difference calculator 150, and an image compensator 160.

The degradation determiner 110 may be coupled to sensing lines formed in a display panel. The degradation determiner 110 may detect current flowing through pixels coupled to each of the sensing lines, and may detect a degradation of the pixels respectively coupled to sensing lines based on the current. The plurality of pixels and a plurality of the sensing lines may be formed in the display panel. Each of the sensing lines may be coupled to respective ones of the pixels. The sensing lines may be formed in a horizontal direction or in a vertical direction.

The degradation determiner 110 may detect the current flowing through the pixels coupled to each of the sensing lines when a reference image (e.g., a predetermined reference image) is provided to the pixels in the display panel from an external device. For example, the degradation determiner 110 may include an integrator coupled to the sensing line. The degradation determiner 110 may detect the degradation of pixels coupled to each of the sensing lines by integrating the current flowing through the pixels coupled to each of the sensing lines using the integrator. The degradation determiner 110 may detect the degradation of pixels coupled to a sensing line when the current detected through the sensing line is lower than a reference current (e.g., a predetermined reference current). The degradation determiner 110 may determine that the pixels coupled to the sensing line are not degraded when the current detected through the sensing line is higher than the reference current. Image data R, G, B may be directly provided to a data driver.

The sensor 120 may assign a first region and a second region. The second region may include at least one pixel adjacent the first region. The sensor 120 may sense a first sensing data SD1 of the first region, and may sense a second sensing data SD2 of the second region. The sensor 120 may assign, or detect/determine, at least one first region that includes at least one of the pixels coupled to the sensing line through which the degradation is detected. The first region may include at least one pixel. For example, when one sensing line through which the degradation is detected is coupled to 500 pixels, and when the first region includes 5 pixels, the sensor 120 may assign/detect/determine 100 first regions. The sensor 120 may sense a first current flowing through the pixels in the first region, and may output the first current as the first sensing data SD1. For example, when the sensor 120 assigns the 100 first regions, the sensor 120 may output 100 first sensing data SD1.

The sensor 120 may assign at least one second region adjacent the first region. For example, the sensor 120 may assign pixels at an upper side of, or above, the first region, pixels at a lower side of, or below, the first region, pixels at a left side of the first region, and pixels at a right side of the first region as the second regions. The number of pixels in each of the second regions may be the same as, or substantially the same as, the number of pixels in the first region. For example, when the first region includes 5 pixels, each of the second regions may include 5 pixels at the upper side of the first region, 5 pixels at the lower side of the first region, 5 pixels at the left side of the first region, and 5 pixels at the right side of the first region.

The sensor 120 may sense the second current flowing through the pixels in each of the second regions, and may output the second current as the second sensing data SD2. That is, the sensor 120 may output one first sensing data SD1, and may output at least one second sensing data SD2 corresponding to the first sensing data SD1. For example, when the sensor 120 assigns the 100 first regions, and assigns the 400 second regions, which are adjacent each of the first regions in upper, lower, left, and right directions, the sensor 120 may output the 100 first sensing data SD1, and may output the 400 second sensing data SD2 corresponding to the 100 first sensing data SD1.

The degradation calculator 130 may determine whether the pixels in the first region are degraded based on the first sensing data SD1 and the second sensing data SD2, and may calculate a compensating amount of a degradation DC of the first region. The degradation calculator 130 may receive the first sensing data SD1, and may receive at least one second sensing data SD2 corresponding to the first sensing data SD1. The degradation calculator 130 may calculate an average value of the second sensing data SD2. The degradation calculator 130 may determine that the pixels in the first region are degraded when the first sensing data SD1 is lower than the average value of the second sensing data SD2. For example, when the degradation calculator 130 receives one first sensing data SD1 and four second sensing data SD2, the degradation calculator 130 may calculate the average value of the four second sensing data SD2, and may compare the first sensing data SD1 to the average value of the four second sensing data SD2. Here, the degradation calculator 130 may determine that the pixels in the first region are degraded when the first sensing data SD1 is lower than the average value of the four second sensing data SD2. The degradation calculator 130 may calculate the compensating amount of the degradation DC. The compensating amount of the degradation DC may be a difference between the first sensing data SD1 and the average value of the second sensing data SD2. For example, when the first sensing data SD1 and the second sensing data SD2 are current values, the compensating amount of the degradation DC may also be a current value.

The brightness calculator 140 may calculate a compensating amount of a brightness BC that compensates a brightness of the first region based on the compensating amount of the degradation DC. The brightness calculator 140 may include a look up table (LUT) that stores the compensating amount of the brightness BC corresponding to the compensating amount of the degradation DC (e.g., that stores a plurality of compensating amounts of the brightness BC that respectively correspond to one of a plurality of compensating amounts of the degradation DC). For example, when the first sensing data SD1 and the second sensing data SD2 are current values, the look up table may store brightness data, which corresponds to the difference between the current value of the first sensing data SD1 and the average current value of the second sensing data SD2, as the compensating amount of the brightness BC.

The color difference calculator 150 may calculate a compensating amount of a color difference CC that compensates a color difference of the first region based on the compensating amount of the degradation DC. The color difference calculator 150 may include a look up table that stores the compensating amount of the color difference CC corresponding to the compensating amount of the degradation DC. For example, when the first sensing data SD1 and the second sensing data SD2 are current values, the look up table may store color difference data, which corresponds to the difference between the current value of the first sensing data SD1 and the average current value of the second sensing data SD2, as the compensating amount of the color difference CC.

The image compensator 160 may compensate image data R, G, B based on the compensating amount of the brightness BC and the compensating amount of the color difference CC. The image compensator 160 may compensate the brightness and the color difference of the image data R, G, B provided to the first region when the image data R, G, B is provided to the image compensator 160. The image compensator 160 may compensate the brightness of the image data R, G, B based on the compensating amount of the brightness BC. For example, the image compensator 160 may compensate the image data R, G, B provided to the first region by changing a gray level value of the image data R, G, B provided to the first region based on the compensating amount of the brightness BC. Alternatively, the image compensator 160 may compensate the image data R, G, B provided to the first region by changing a dimming value of the image data R, G, B provided to the first region based on the compensating amount of the brightness BC. The image compensator 160 may compensate the color difference of the image data R, G, B based on the compensating amount of the color difference CC. For example, the image compensator 160 may compensate a color coordinate of the image data R, G, B provided to the first region using a gamut mapping algorithm (GMA) based on the compensating amount of the color difference CC. Here, when the color coordinate is rapidly changed, a user may recognize the change of the image. To prevent, or substantially prevent, the user from recognizing the change of the image, one of the changing amounts of a red color coordinate, a green color coordinate, and a blue color coordinate may increase. For example, the changing amount of the blue color coordinate may be relatively increased because the human eye is more sensitive to the changing amount of the blue color coordinate by Macadam Ellipse that is formed by coupling the color coordinates that have the same, or substantially the same, color difference in a plurality of gray levels. As such, the image data R, G, B may be naturally compensated.

As described above, the degradation compensating device 100 may assign the first region, in which the degradation of the pixels is detected through the sensing line, and may assign the second region that includes the pixels adjacent the first region. The degradation compensating device 100 may compensate the brightness and the color difference of the image data R, G, B provided to the first region based on the difference between the first sensing data SD1 of the first region and the average value of the second sensing data SD2 of the second regions. The degradation compensating device 100 may naturally compensate the image data R, G, B provided to the first region by determining whether pixels in the first region are degraded based on the first sensing data SD1 and the second sensing data SD2, and by compensating the degradation of the pixels in the first region.

FIGS. 2A through 2D are diagrams illustrating examples of a display panel coupled to the degradation compensating device of FIG. 1.

Figure 2A:
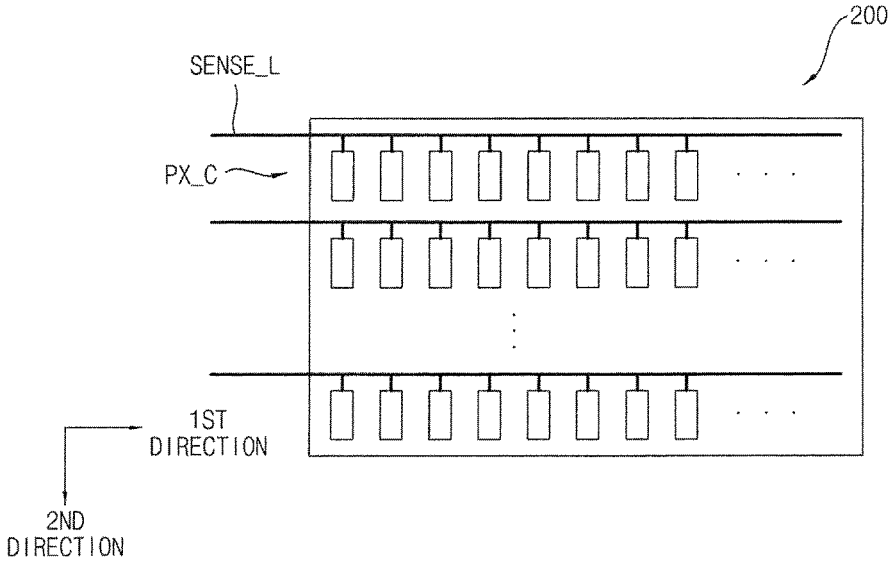
FIGS. 2A through 2D are diagrams illustrating examples of a display panel coupled to the degradation compensating device of FIG. 1.

Referring to FIG. 2A, the sensing lines SENSE_L may extend in a first direction 1ST DIRECTION. Each of the sensing lines SENSE_L may be coupled to respective pixel columns PX_C. For example, when 100 pixel columns PX_C are formed in the display panel 200, 100 sensing lines SENSE_L respectively coupled to the pixel columns PX_C may be formed in the display panel 200. The degradation determiner 110 may detect the degradation of the pixel column PX_C coupled to the sensing line SENSE_L by detecting the current flowing through the pixel column PX_C coupled to the sensing line SENSE_L.

Figure 2B:
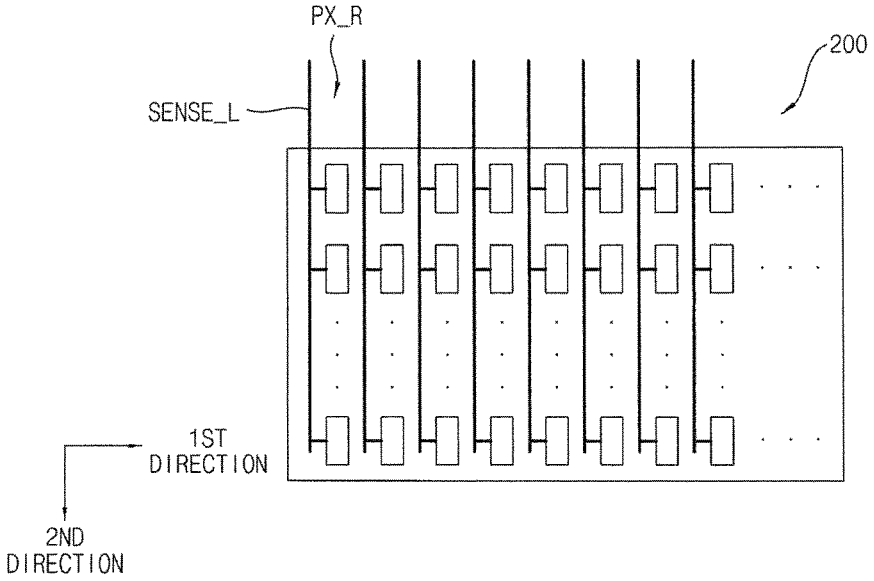

Referring to FIG. 2B, the sensing lines SENSE_L may extend in a second direction 2ND DIRECTION. Each of the sensing lines SENSE_L may be coupled to each of pixel rows PX_R. For example, when 100 pixel rows are formed in the display panel 200, 100 sensing lines SENSE_L respectively coupled to the pixel rows PX_R may be formed in the display panel 200. The degradation determiner 110 may detect the degradation of the pixel row PX_R coupled to the sensing line SENSE_L by detecting the current flowing through the pixel row PX_R coupled to the sensing line SENSE_L.

Figure 2C:
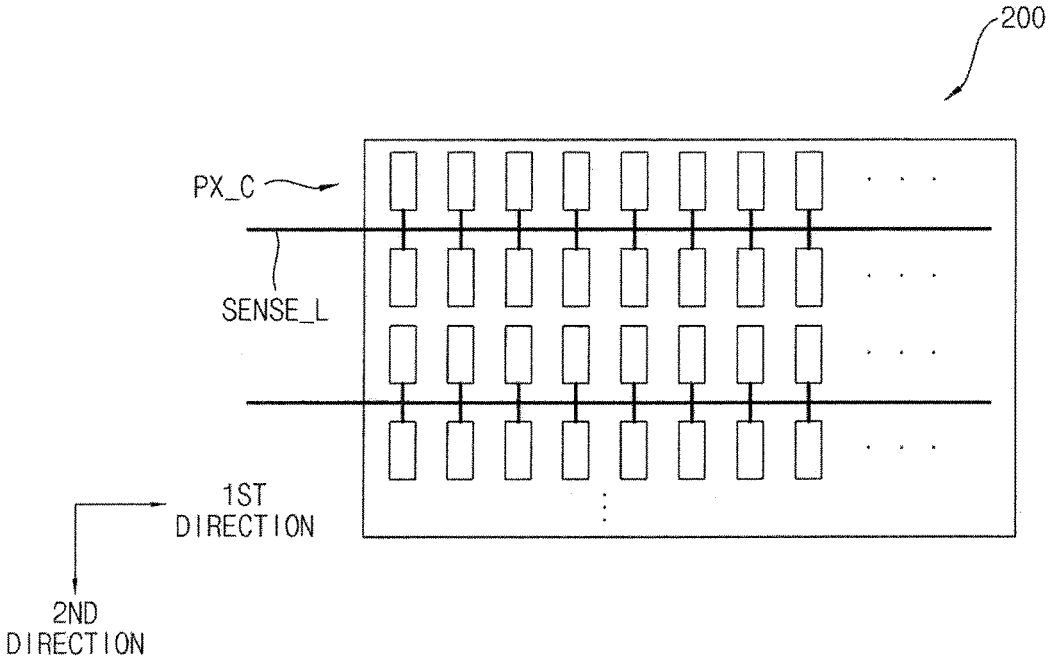

Referring to FIG. 2C, the sensing lines SENSE_L may extend in the first direction 1ST DIRECTION. Each of the sensing lines SENSE_L may be coupled to 2 pixel columns PX_C (e.g., a pair of pixels in each column). For example, when 100 pixel columns are formed in the display panel 200, each of 50 sensing lines SENSE_L may be coupled to 2 pixel columns PX_C (e.g., may be coupled to respective pairs of pixels located in columns). The degradation determiner 110 may detect the degradation of the pixel columns PX_C coupled to the sensing line SENSE_L by detecting the current flowing through the pixel columns PX_C coupled to the sensing line SENSE_L.

Figure 2D:
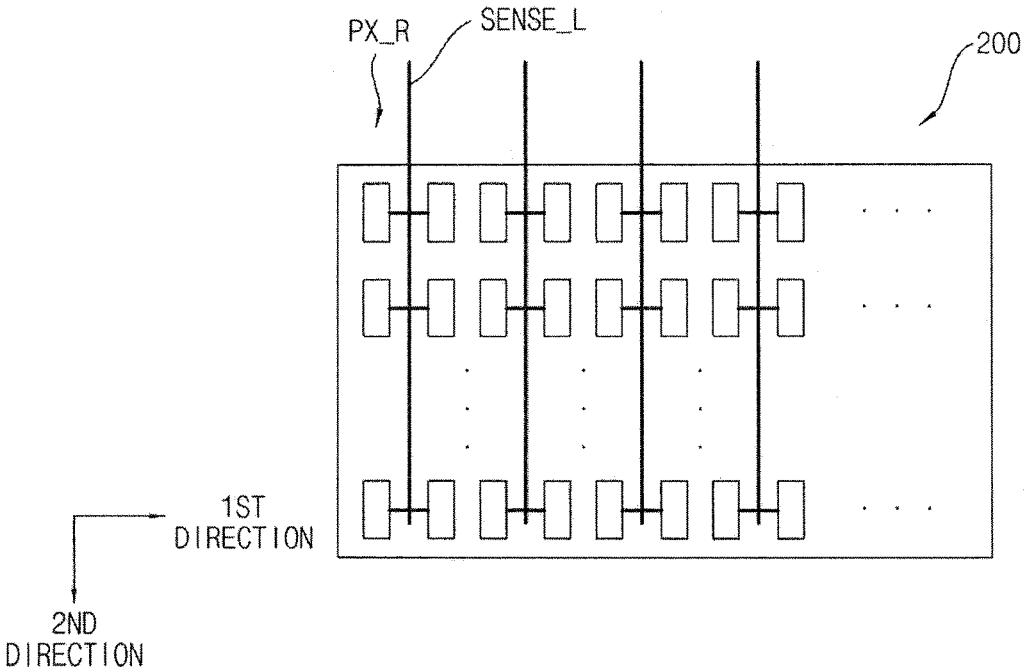

Referring to FIG. 2D, the sensing lines SENSE_L may extend in the second direction 2ND DIRECTION. Each of the sensing lines SENSE_L may be coupled to 2 pixel rows PX_R (e.g., respective pairs of pixels, each of the pairs being located in a respective common row). For example, when 100 pixel rows are formed in the display panel 200, each of 50 sensing lines SENSE_L may be coupled to 2 pixel rows PX_R (e.g., may be coupled to a plurality of paired pixels of respective rows). The degradation determiner 110 may detect the degradation of the pixel rows PX_R coupled to the sensing line SENSE_L by detecting the current flowing through the pixel rows PX_R coupled to the sensing line SENSE_L.

Although the sensing lines SENSE_L coupled to one or two pixel columns PX_C or coupled to one or two pixel rows PX_R are described in FIGS. 2A through 2D, the sensing lines SENSE_L are not limited thereto. For example, each of the sensing lines SENSE_L may be coupled to more than two pixel columns PX_C and/or pixel rows PX_R.

Figure 3A:
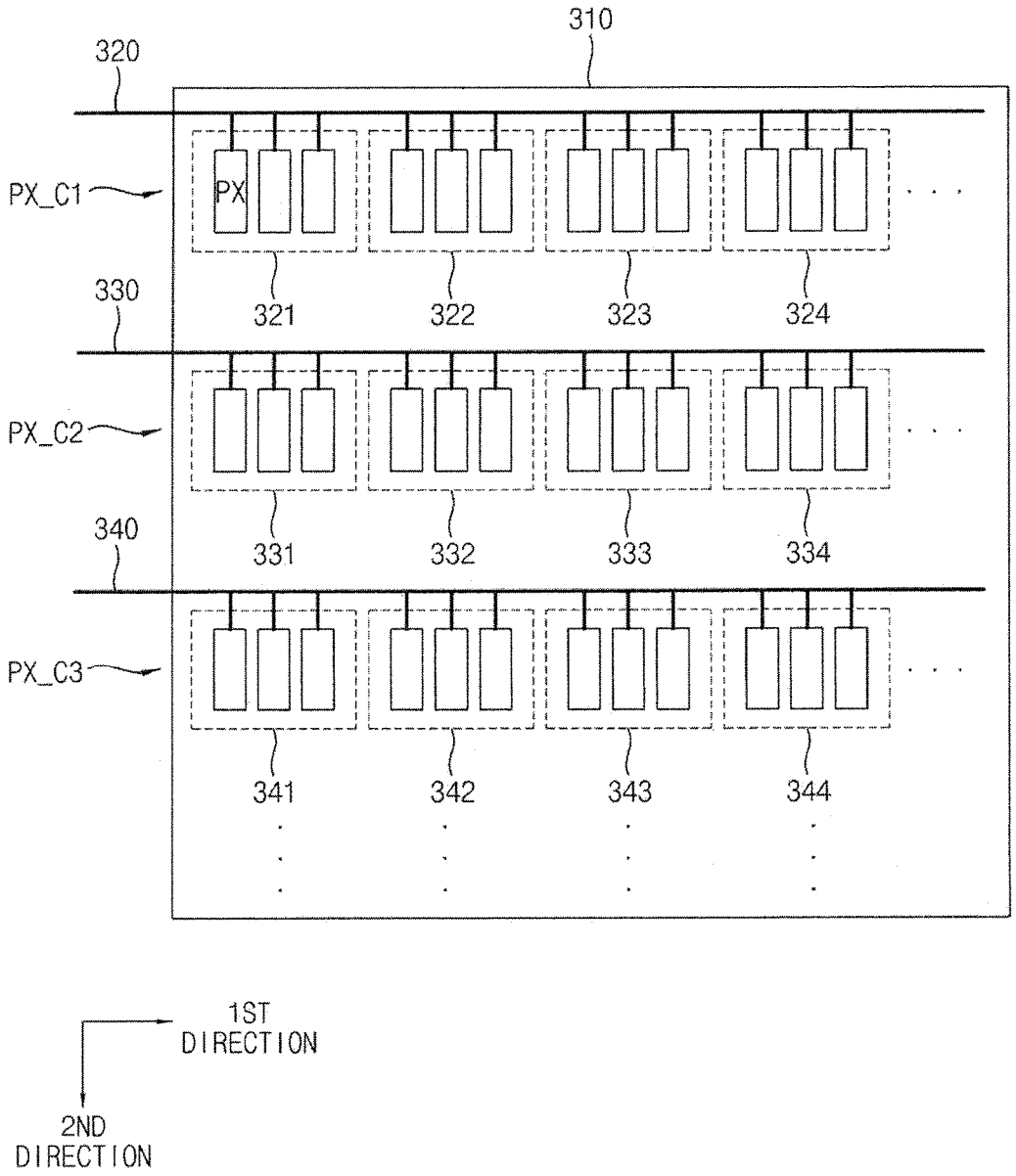
FIGS. 3A and 3B are diagrams illustrating an operation of a sensor included in the degradation compensating device of FIG. 1.
Figure 3B:
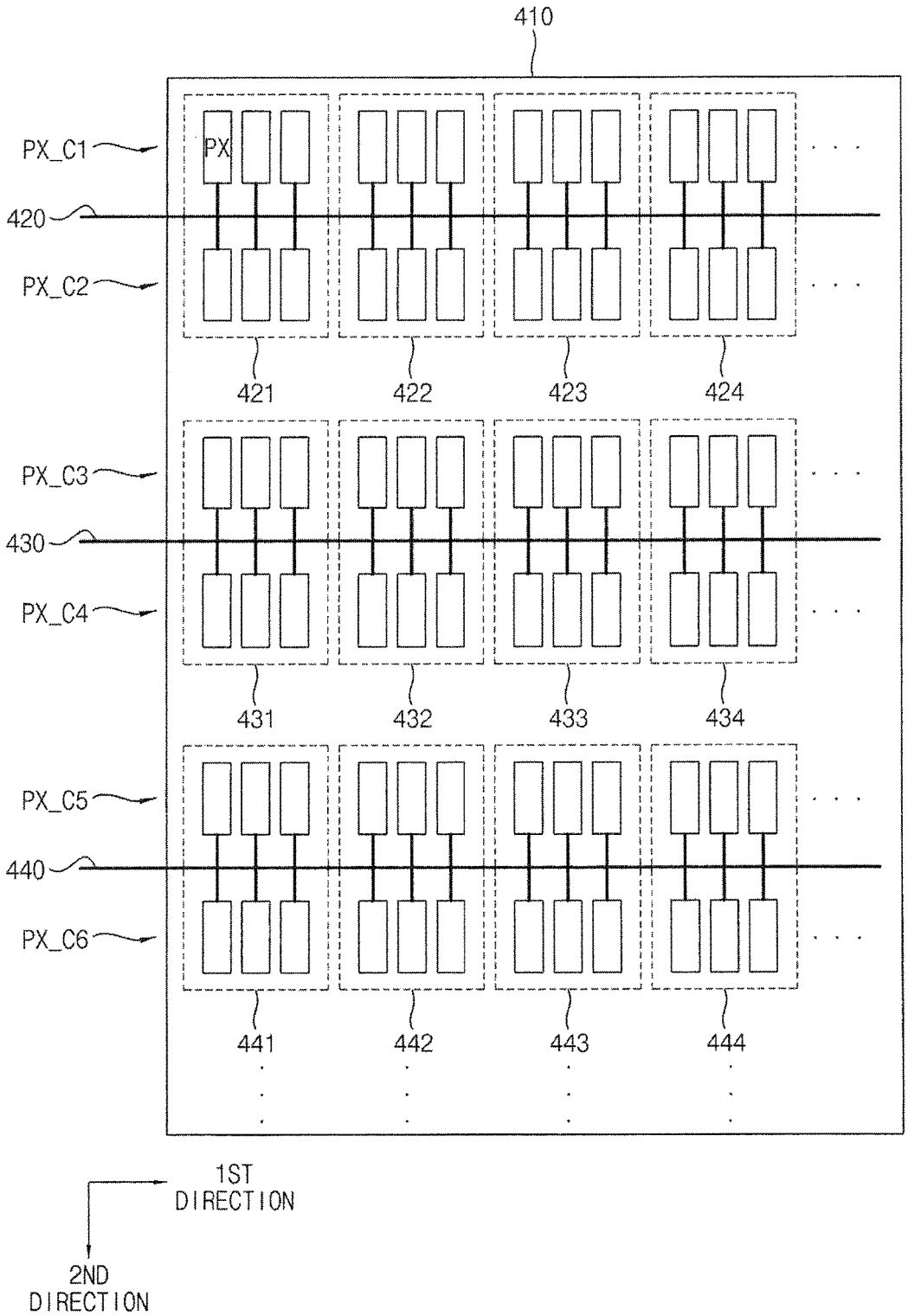

FIGS. 3A and 3B are diagrams illustrating an operation of a sensor included in the degradation compensating device of FIG. 1.

The sensor 120 may assign at least one first region, which includes at least one of the pixels coupled to the sensing line through which the degradation is detected. Here, the first region may include at least one pixel PX. Further, the sensor 120 may assign at least one second region adjacent the first region. The sensor 120 may assign at least one second region corresponding to the first region. Here, the number of pixels in each of the second regions may be the same as, or substantially the same as, the number of pixels in the first region.

Referring to FIG. 3A, sensing lines 320, 330, 340 may extend in the first direction 1ST DIRECTION. Each of the sensing lines 320, 330, 340 may be respectively coupled to the pixel columns PX_C1, PX_C2, PX_C3. For example, when the degradation is detected in a second sensing line 330 coupled to a second pixel column PX_C2, the sensor 120 may assign first regions 331, 332, 333, 334, which each include 3 pixels PX coupled to the second sensing line 330. The sensor 120 may sense the first current flowing through the pixels PX in each of the first regions 331, 332, 333, 334, and may output the first current as the first sensing data SD1 for each of the first regions.

The sensor 120 may assign second regions 321, 332, 341, which include the pixels PX that are adjacent the first region 331 (e.g., above, below, and to the right of the first region 331). Also, the sensor 120 may assign second regions 322, 331, 333, 342 which include the pixels PX adjacent the first region 332. The sensor 120 may also assign second regions 323, 332, 334, 343, which include the pixels PX adjacent the first region 333. The sensor 120 may assign second regions 324, 333, 344, which include the pixels PX that are adjacent the first region 334. The sensor 120 may assign the second regions adjacent the first regions in this way, may sense the second current flowing through the pixels PX in each of the second regions, and may output the second current as the second sensing data SD2.

Although the second regions formed at an upper side, a lower side, a left side, and a right side of the first region are described in FIG. 3A, the second regions are not limited thereto. The sensor 120 may assign the second regions, which include the pixels PX formed in an orthogonal direction of the first region.

Referring to FIG. 3B, sensing lines 420, 430, 440 may extend in the first direction 1ST DIRECTION. Each of the sensing lines 420, 430, 440 may be coupled to two respective pixel columns. For example, when the degradation is detected in a second sensing line 430 that is coupled to a third pixel column PX_C3 and to a fourth pixel column PX_C4, the sensor 120 may assign first regions 431, 432, 433, 434, which each include 6 pixels PX coupled to the second sensing line 430. The sensor 120 may sense the first current flowing through the pixels PX in each of the first regions 431, 432, 433, 434, and may output the first current as the first sensing data SD1.

The sensor 120 may assign second regions 421, 432, 441, which include the pixels adjacent the first region 431. The sensor 120 may assign second regions 422, 431, 433, 442, which include the pixels adjacent the first region 432. The sensor 120 may assign second regions 423, 432, 434, 443, which include the pixels adjacent the first region 433. The sensor 120 may assign second regions 424, 433, and 444, which include the pixels adjacent the first region 434. The sensor 120 may assign the second regions adjacent the first regions in this way. The sensor 120 may sense the second current flowing through the pixels PX in each of the second regions, and may output the second current as the second sensing data SD2.

Although the second regions formed at an upper side, a lower side, a left side, and/or a right side of a respective first region are described in FIG. 3B, the second regions are not limited thereto. The sensor 120 may assign the second regions which include the pixels PX formed in an orthogonal direction of the first region.

Figure 4:
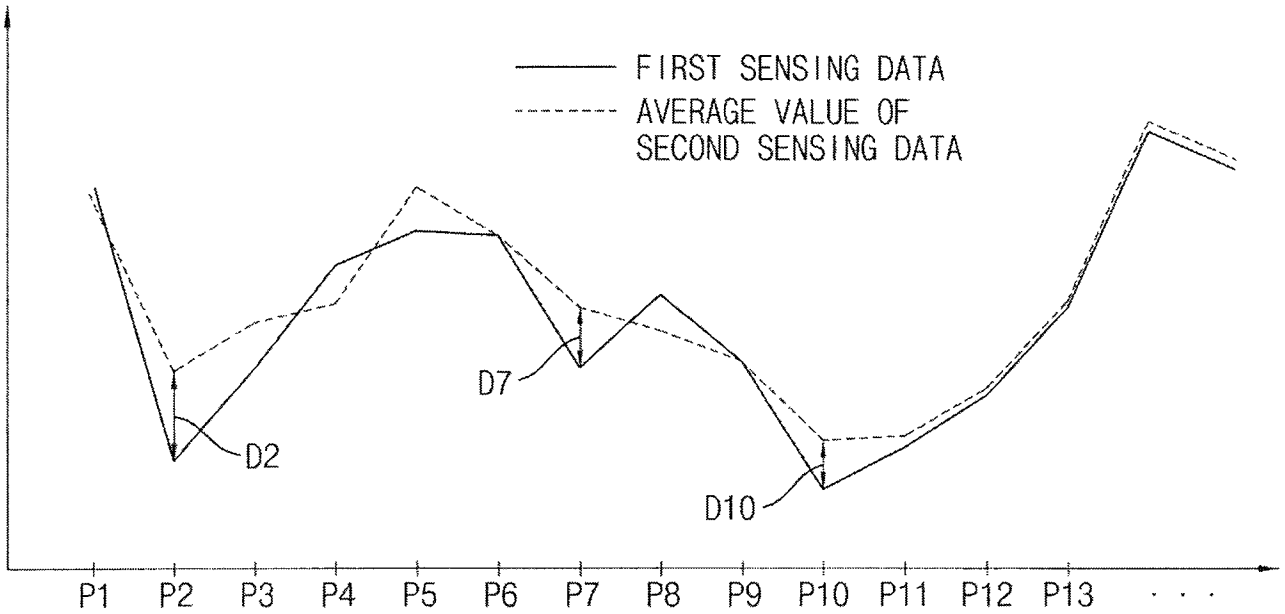
FIG. 4 is a graph illustrating an operation of a degradation calculator included in the degradation compensating device of FIG. 1.

FIG. 4 is a graph illustrating an operation of a degradation calculator included in the degradation compensating device of FIG. 1.

The degradation calculator 130 may determine whether the pixels in the first region are degraded based on the first sensing data SD1 and the second sensing data SD2, and may calculate the compensating amount of the degradation DC. The degradation calculator 130 may receive one first sensing data SD1 and at least one second sensing data SD2 corresponding to the first sensing data SD1. The degradation calculator 130 may determine whether the pixels in the first region are degraded by comparing the first sensing data SD1 and the average value of the second sensing data SD2. For example, when the degradation calculator 130 receives one first sensing data SD1, and receives four second sensing data SD2 corresponding to the first sensing data SD1, the degradation calculator 130 may calculate the average value of the second sensing data SD2, and may compare the first sensing data SD1 and the average value of the second sensing data SD2. The degradation calculator 130 may determine that the pixels in the first region are degraded when the first sensing data SD1 is lower than the average value of the second sensing data SD2. The degradation calculator 130 may calculate the difference between the first sensing data SD1 and the average value of the second sensing data SD2, and may output the difference as the compensating amount of the degradation DC.

FIG. 4 is a graph illustrating the first sensing data SD1 of the first regions, and illustrating the average value of the second sensing data SD2 of the second regions adjacent each of the first regions. Referring to FIG. 4, the degradation determiner 110 may determine that the pixels in the first regions in P2, P7, and P10 are degraded because the first sensing data SD1 in the first regions in P2, P7, and P10 are lower than the average value of the second sensing data SD2 corresponding to the first regions P2, P7, and P10. That is, the degradation calculator 130 may determine that the first regions in P2, P7, and P10 are degraded. The degradation determiner 110 may output the difference D2 between the first sensing data SD1 and the average value of the second sensing data SD2 as the compensating amount of the degradation DC of the first regions in P2. The degradation determiner 110 may output the difference D7 between the first sensing data SD1 and the average value of the second sensing data SD2 as the compensating amount of the degradation DC of the first regions in P7. The degradation determiner 110 may output the difference D10 between the first sensing data SD1 and the average value of the second sensing data SD2 as the compensating amount of the degradation DC of the first regions in P10. For example, the compensating amount of the degradation DC may be the current value when the first sensing data SD1 and the second sensing data SD2 are the current value.

Figure 5:
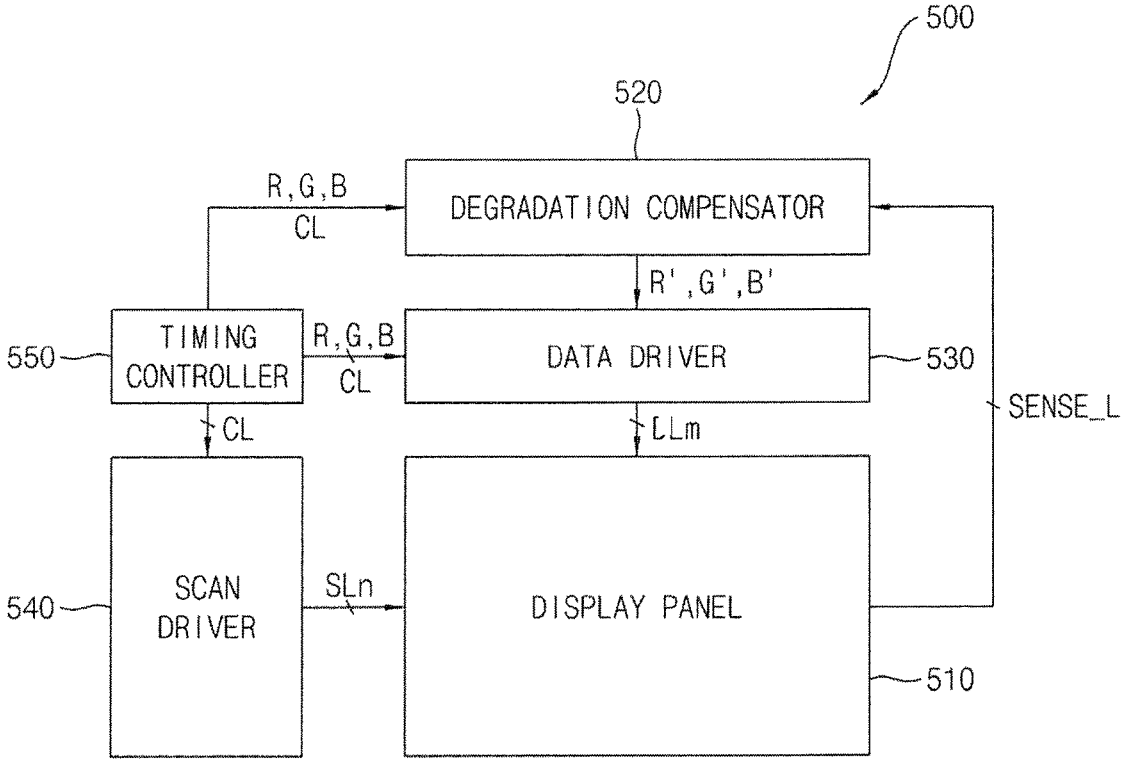
FIG. 5 is a block diagram illustrating a display device according to example embodiments.

FIG. 5 is a block diagram illustrating a display device according to example embodiments.

Referring to FIG. 5, a display device 500 may include a display panel 510, a degradation compensator 520, a data driver 530, a scan driver 540, and a timing controller 550. Here, the degradation compensator 520 may correspond to the degradation compensating device 100 of FIG. 1.

The display panel 510 may include a plurality of pixels. A plurality of scan lines SLn and a plurality of data lines DLm may be formed on the display panel 510. The pixels may be formed at respective crossing regions of the scan lines SLn and the data lines DLm. In some example embodiments, each of the pixels may include a pixel circuit, a driving transistor, and an organic light emitting diode. The driving transistor may control a driving current flowing through the organic light emitting diode based on the data signal. The data signal may be provided to the driving transistor via the data line DLm in response to the scan signal. The scan signal may be provided via the scan line SLn. Sensing lines SENSE_L may be formed on the display panel 510. The sensing lines SENSE_L may be formed in a first direction or a second direction. The sensing lines SENSE_L may be coupled to at least one of the pixel columns PX_C. The sensing lines SENSE_L may be coupled to the degradation compensator 520.

The degradation compensator 520 may detect a degradation of the pixels coupled to each of the sensing lines SENSE_L by detecting currents flowing through the pixels coupled to each of the sensing lines SENSE_L. The degradation compensator 520 may assign a first region, which includes at least one of the pixels coupled to the sensing line SENSE_L through which the degradation is detected, and may assign a second region adjacent the first region. The degradation compensator 520 may compensate a brightness and a color difference of the first region based on a first sensing data SD1 of the first region and a second sensing data SD2 of the second region.

For example, the degradation compensator 520 may include a degradation determiner, a sensor, a degradation calculator, a brightness calculator, a color difference calculator, and an image compensator (e.g., see FIG. 1). The degradation compensator 520 may detect a degradation of the pixels coupled to each of the sensing lines SENSE_L by detecting the current flowing through the pixels coupled to each of the sensing lines SENSE_L. The degradation determiner may detect the current flowing through the pixels coupled to the sensing lines SENSE_L when a reference image is displayed on the display panel 510. The degradation determiner may detect the degradation of the pixels coupled to the sensing line SENSE_L when the current detected through the sensing line SENSE_L is lower than a reference current. The degradation determiner may determine that the pixels coupled to the sensing line SENSE_L are not degraded when the current detected through the sensing line SENSE_L is higher than the reference current. In different embodiments, the degradation determiner may determine that the pixels are, or are not, degraded when the current detected through the sensing line SENSE_L is equal to the reference current.

Image data R, G, B provided from an external device may be directly provided to the data driver 530. The sensor may assign at least one first region, which includes at least one pixel, and may assign at least one second region adjacent the first region. The sensor may sense the first sensing data SD1 of the first region and the second sensing data SD2 of the second region. The sensor may assign at least one first region, which includes at least one of the pixels coupled to the sensing line SENSE_L through which the degradation is detected. The first region may include at least one pixel. The sensor may sense a first current flowing through the pixels in the first region, and may output the first current as the first sensing data SD1. The sensor may assign at least one second region adjacent, or corresponding to, the first region. The second region may include at least one pixel adjacent the pixel in the first region. The number of pixels in each of the second regions may be the same, or substantially the same, as the number of pixels in the first region. The sensor may sense a second current flowing through the pixels in the second region(s), and may output the second current as the second sensing data SD2. That is, the sensor may output one first sensing data SD1, and may output at least one second sensing data SD2 corresponding to the first sensing data SD1.

The degradation calculator may determine whether the pixels in the first region are degraded based on the first sensing data SD1 and the second sensing data SD2, and may calculate a compensating amount of the degradation DC. The degradation calculator may receive the first sensing data SD1, and may also receive at least one second sensing data SD2 corresponding to the first sensing data SD1. The degradation calculator may calculate an average value of the second sensing data SD2. The degradation calculator may determine that the pixels in the first region are degraded when the first sensing data SD1 is lower than the average value of the second sensing data SD2. The degradation calculator may calculate a difference between the first sensing data SD1 and the average value of the second sensing data SD2 as the compensating amount of the degradation DC.

The brightness calculator may calculate the compensating amount of the brightness BC that compensates the brightness of the pixels in the first region based on the compensating amount of the degradation DC. The brightness calculator may include a look up table that stores the compensating amount of the brightness BC corresponding to the compensating amount of the degradation DC. The color difference calculator may calculate a compensating amount of the color difference CC that compensates the color difference of the pixels in the first region based on the compensating amount of the degradation DC. The color difference calculator may include a look up table that stores the compensating amount of the color difference CC corresponding to the compensating amount of the degradation DC.

The image compensator may compensate image data R, G, B based on the compensating amount of the brightness BC and based on the compensating amount of the color difference CC. The image compensator may compensate the brightness and the color difference of the image data R, G, B provided to the first region. The image compensator may compensate the brightness of the image data R, G, B provided to the first region based on the compensating amount of the brightness BC. For example, the image compensator may change a gray level value of the image data R, G, B provided to the first region based on the compensating amount of the brightness BC. Alternatively, the image compensator may change a dimming value of the image data R, G, B provided to the first region based on the compensating amount of the brightness BC.

The image compensator may compensate the color difference of the image data R, G, B provided to the first region based on the compensating amount of the color difference CC. For example, the image compensator may compensate a color coordinate of the image data R, G, B provided to the first region based on the compensating amount of the color difference CC using a gamut mapping algorithm. Here, when the color coordinate is rapidly changed, a user may recognize the change of the image. To prevent, or substantially prevent, the user from recognizing the change of the image, one of the changing amounts of a red color coordinate, a green color coordinate, and a blue color coordinate may increase. For example, the changing amount of the blue color coordinate may increase because the human eye responds sensitively to the changing amount of the blue color coordinate by Macadam Ellipse that is formed by coupling the color coordinates that have the same, or substantially the same, color difference in a plurality of gray levels. The image data R, G, B may be naturally compensated. The compensated image data R', G', B' may be provided to the data driver 530.

The scan driver 540 may provide the scan signals to the pixels through the scan lines SLn. The data driver 530 may provide the data signals to the pixels through the data lines DLm. The timing controller 550 may generate control signals CL that control the degradation compensator 520, the data driver 530, and the scan driver 540. The degradation compensator 520 may be coupled to the timing controller 550, or may be located in the timing controller 550.

As described above, according to example embodiments the display device 500 may include the degradation compensator 520. The degradation compensator 520 may detect the degradation of the pixels through the sensing lines SENSE_L formed in the display panel 510, may assign the first region in which the degradation of the pixels is detected through the sensing lines SENSE_L, may assign the second regions adjacent the first region, and may compensate the image data R, G, B provided to the first region based on the difference between the first sensing data SD1 of the first region and the average value of the second sensing data SD2 of the second regions. The degradation compensator 520 may naturally compensate the image data R, G, B provided to the degraded pixels by determining whether the pixels in the first region are degraded based on the first sensing data SD1 of the first region and the second sensing data SD2 of the second regions that is adjacent the first region, and by compensating the first region. Thus, the display device 500 may display a high-quality image on the display panel 510.

Figure 6:
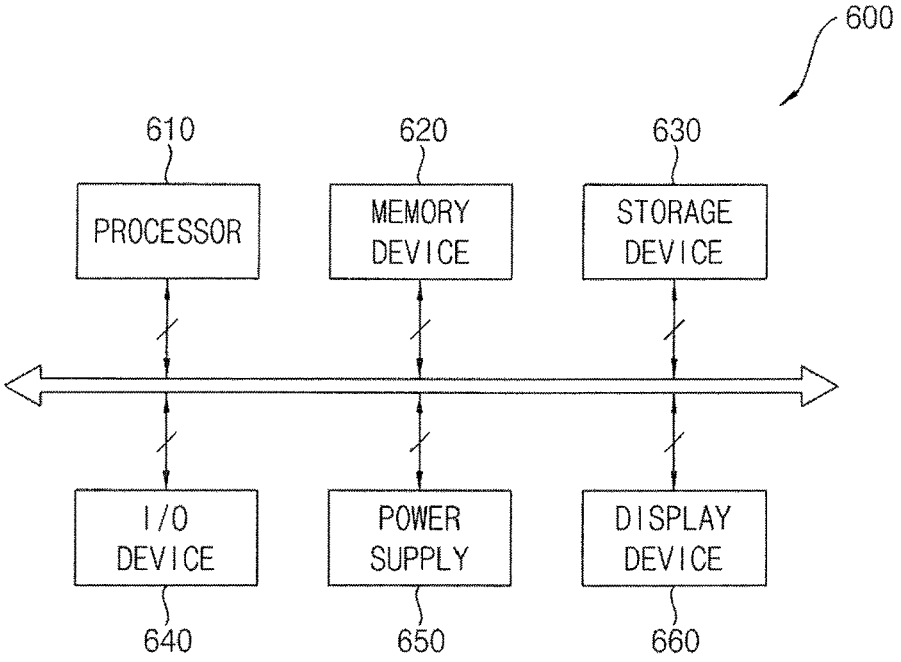
FIG. 6 is a block diagram illustrating an electronic device which includes the display device of FIG. 5.
Figure 7:
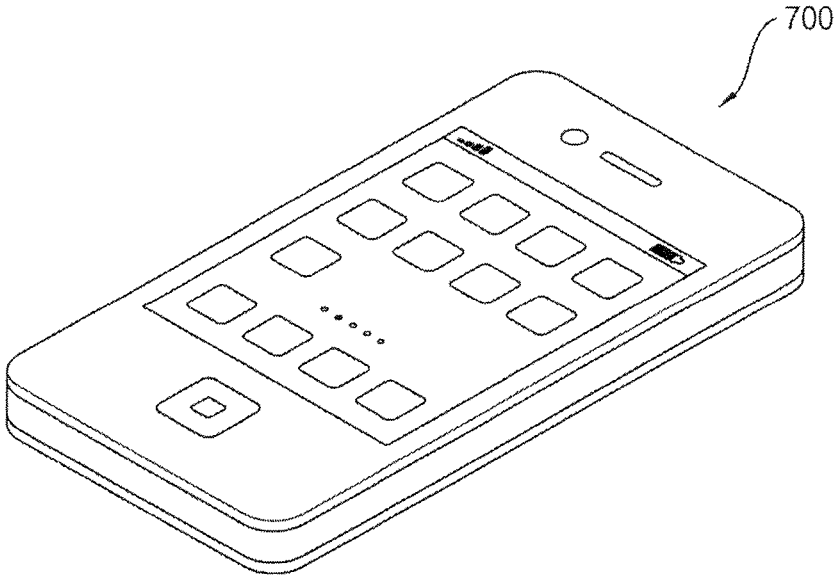
FIG. 7 is a diagram illustrating an example embodiment in which the electronic device of FIG. 6 is implemented as a smartphone.

FIG. 6 is a block diagram illustrating an electronic device, which includes the display device of FIG. 5, and FIG. 7 is a diagram illustrating an example embodiment in which the electronic device of FIG. 6 is implemented as a smartphone.

Referring to FIGS. 6 and 7, an electronic device 600 may include a processor 610, a memory device 620, a storage device 630, an input/output (I/O) device 640, a power device/power supply 650, and a display device 660. Here, the display device 660 may correspond to the display device 500 of FIG. 5. In addition, the electronic device 600 may further include a plurality of ports for communicating a video card, a sound card, a memory card, a universal serial bus (USB) device, other electronic devices, etc. Although it is illustrated in FIG. 7 that the electronic device 600 is implemented as a smartphone 700, a type of the electronic device 600 is not limited thereto.

The processor 610 may perform various computing functions. The processor 610 may be a microprocessor, a central processing unit (CPU), etc. The processor 610 may be coupled to other suitable components via an address bus, a control bus, a data bus, etc. Further, the processor 610 may be coupled to an extended bus such as a peripheral component interconnect (PCI) bus. The memory device 620 may store data for operations of the electronic device 600. For example, the memory device 620 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 630 may be a solid state drive (SSD) device, a hard disk drive (HDD) device, a CD-ROM device, etc.

The I/O device 640 may be an input device such as a keyboard, a keypad, a touchpad, a touch-screen, a mouse, etc., and an output device such as a printer, a speaker, etc. In some example embodiments, the display device 660 may be included in the I/O device 640. The power device 650 may provide power for operations of the electronic device 600.

The display device 660 may communicate with other components via the buses or other suitable communication links. As described above, the display device 660 may include a display panel, a degradation compensator, a data driver, a scan driver, and a timing controller. The display panel may include a plurality of pixels. Sensing lines coupled to the pixels may be formed on the display panel.

The degradation compensator may detect the degradation of the pixels through the sensing line and compensate a brightness and a color difference of pixels in a first region based on first sensing data of the first region and second sensing data of a second region adjacent the first region. The degradation compensator may include a degradation determiner, a sensor, a degradation calculator, a brightness calculator, a color difference calculator, and an image compensator. The degradation determiner may detect a degradation of the pixels coupled to each of the sensing lines by detecting the current flowing through the pixels coupled to each of the sensing lines. The degradation determiner may detect the degradation of the pixels coupled to the sensing line when the current detected through the sensing line is lower than a reference current. The sensor may assign at least one first region which includes at least one pixel and at least one second region adjacent the first region and sense the first sensing data of the first region and the second sensing data of the second region. The sensor may sense a first current flowing through the pixels in the first region and output the first current as the first sensing data. The sensor may sense a second current flowing through the pixels in the second region and output the second current as the second sensing data. The degradation calculator may calculate an average value of the second sensing data. The degradation calculator may determine that the pixels in the first region are degraded when the first sensing data is lower than the average value. The degradation calculator may calculate a difference between the first sensing data and the average value of the second sensing data as the compensating amount of the degradation. The brightness calculator may calculate the compensating amount of the brightness that compensates the brightness of the pixels in the first region based on the compensating amount of the degradation. The brightness calculator may include a look up table that stores the compensating amount of the brightness corresponding to the compensating amount of the degradation. The color difference calculator may calculate a compensating amount of the color difference that compensates the color difference of the pixels in the first region based on the compensating amount of the degradation. The color difference calculator may include a look up table that stores the compensating amount of the color difference corresponding to the compensating amount of the degradation. The image compensator may compensate image data based on the compensating amount of the brightness and the compensating amount of the color difference.

The scan driver may provide the scan signals to the pixels through the scan lines. The data driver may provide the data signals to the pixels through the data lines. The timing controller may generate control signals that control the degradation compensator, the data driver, and the scan driver.

As described above, the electronic device 600 of FIG. 6 may naturally compensate the image data provided to the degraded pixels by including the display device 460 that detects the degradation of the pixels through the sensing line formed on the display panel, may assign the first region coupled to the sensing line through which the degradation of the pixel is detected, assigns the second regions adjacent the first region, and may compensate the image data provided to the first region based on the first sensing data of the first region and the average value of the second sensing data of the second regions. Thus, the electronic device 600 which includes the display device 460 may display a high-quality image on the display panel.

The present inventive concept may be applied to a display device and an electronic device having a display device. For example, the present inventive concept may be applied to a computer monitor, a laptop, a digital camera, a cellular phone, a smartphone, a smart pad, a television, a personal digital assistant (PDA), a portable multimedia player (PMP), an MP3 player, a navigation system, a game console, a video phone, etc.

The foregoing is illustrative of example embodiments of the present invention and is not to be construed as limiting thereof. Although a few example embodiments have been described, those skilled in the art will readily appreciate that many modifications are possible in the example embodiments without materially departing from the novel teachings and features of the present inventive concept. Accordingly, all such modifications are intended to be included within the scope of the present inventive concept as defined in the appended claims and their equivalents. Therefore, it is to be understood that the foregoing is illustrative of various suitable example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A degradation compensating device comprising:

a degradation determiner coupled to sensing lines in a display panel, each sensing line being coupled to a plurality of pixels, the degradation determiner being configured to detect a degradation of the plurality of pixels based on a current flowing through the plurality of pixels;

a sensor configured to:

assign a first region comprising at least one of the pixels that is coupled to one of the sensing lines through which the degradation is detected;

assign a second region comprising ones of the pixels adjacent the first region;

sense a first sensing data of the first region; and sense a second sensing data of the second region;

a degradation calculator configured to determine whether at least one of the pixels in the first region is degraded based on the first sensing data and on the second sensing data, and to calculate a compensating amount of the degradation of the first region;

a brightness calculator configured to calculate a brightness compensating amount for compensating the brightness of the first region based on the compensating amount of the degradation;

a color difference calculator configured to calculate a color compensating amount for compensating a color difference of the first region based on the compensating amount of the degradation; and an image compensator configured to compensate image data based on the brightness compensating amount and on the color compensating amount.

2. The degradation compensating device of claim 1, wherein the degradation determiner is further configured to detect the degradation of the pixels when the current is lower than a reference current.

3. The degradation compensating device of claim 1, wherein the first sensing data corresponds to a first current that flows through the pixels in the first region, and wherein the sensor is further configured to output the first sensing data.

4. The degradation compensating device of claim 1, wherein the second sensing data corresponds to a second current that flows through the pixels in the second region, and wherein the sensor is further configured to output the second sensing data.

5. The degradation compensating device of claim 1, wherein the brightness calculator comprises a look up table (LUT) for storing the brightness compensating amount corresponding to the compensating amount of the degradation.

6. The degradation compensating device of claim 1, wherein the color difference calculator comprises a look up table (LUT) for storing the color compensating amount corresponding to the compensating amount of the degradation.

7. The degradation compensating device of claim 1, wherein the image compensator is further configured to compensate a color coordinate of the image data for the first region based on the color compensating amount using a gamut mapping algorithm (GMA).

8. The degradation compensating device of claim 1, wherein the degradation calculator is further configured to determine that the pixels in the first region are degraded when a value of the first sensing data is lower than an average value of the second sensing data.

9. The degradation compensating device of claim 8, wherein the degradation calculator is further configured to calculate the compensating amount of the degradation using a difference between the value of the first sensing data and the average value of the second sensing data.

10. A display device comprising:

a display panel comprising a plurality of pixels, and sensing lines respectively coupled to the pixels, each sensing line being coupled to a plurality of pixels;

a degradation compensator configured to:

detect a degradation of the plurality of pixels based on a current flowing through the plurality of pixels; and compensate a brightness and a color difference of a first region comprising at least one of the pixels coupled to a respective one of the sensing lines, through which the degradation is detected, the degradation being detected based on a first sensing data of the first region and based on a second sensing data of a second region comprising pixels adjacent the at least one of the pixels of the first region;

a data driver configured to provide data signals to the pixels;

a scan driver configured to provide scan signals to the pixels; and a timing controller configured to generate control signals that control the degradation compensator, the data driver, and the scan driver.

11. The display device of claim 10, wherein the degradation compensator is coupled to the timing controller, or is located in the timing controller.

12. The display device of claim 10, wherein the degradation compensator comprises:

a degradation determiner configured to detect the current flowing through the pixels, and to detect the degradation of the pixels based on the current;

a sensor configured to assign the first region and the second region, and to sense the first sensing data and the second sensing data;

a degradation calculator configured to determine whether the at least one of the pixels in the first region are degraded based on the first sensing data and on the second sensing data, and to calculate a compensating amount of the degradation of the first region;

a brightness calculator configured to calculate a brightness compensating amount for compensating the brightness of the first region based on the compensating amount of the degradation;

a color difference calculator configured to calculate a color compensating amount for compensating the color difference of the first region based on the compensating amount of the degradation; and an image compensator configured to compensate image data based on the brightness compensating amount and the color compensating amount.

13. The display device of claim 12, wherein the degradation determiner is further configured to detect the degradation of the pixels when the current is lower than a reference current.

14. The display device of claim 12, wherein the sensor is further configured to:

sense a first current flowing through the at least one of the pixels in the first region; and output the first sensing data based on the first current.

15. The display device of claim 12, wherein the sensor is further configured to:

sense a second current flowing through the pixels in the second region; and output the second sensing data based on the second current.

16. The display device of claim 12, wherein the brightness calculator comprises a look up table (LUT) for storing the brightness compensating amount corresponding to the compensating amount of the degradation.

17. The display device of claim 12, wherein the color difference calculator comprises a look up table (LUT) for storing the color compensating amount corresponding to the compensating amount of the degradation.

18. The display device of claim 12, wherein the image compensator is further configured to compensate a color coordinate of the image data for the first region based on the compensating amount of the color difference using a gamut mapping algorithm (GMA).

19. The display device of claim 12, wherein the degradation calculator is further configured to determine that the pixels in the first region are degraded when a value of the first sensing data is lower than an average value of the second sensing data.

20. The display device of claim 19, wherein the degradation calculator is further configured to calculate the compensating amount of the degradation using a difference between the value of the first sensing data and the average value of the second sensing data.

* * * * *